United States Patent [19]

Menger

[11] Patent Number: 4,628,520

[45] Date of Patent: Dec. 9, 1986

[54] COUNTING APPARATUS FOR COUNTING OBJECTS BY MEANS OF A SHADOW MEASUREMENT

[75] Inventor: Jan W. Menger, Amerongen, Netherlands

[73] Assignee: Staalkat B.V., Aalten, Netherlands

[21] Appl. No.: 623,328

[22] Filed: Jun. 22, 1984

[30] Foreign Application Priority Data

Jun. 22, 1983 [NL] Netherlands ..... 8302230

[51] Int. Cl.[4] ..... G06M 7/00

[52] U.S. Cl. ..... 377/6; 377/53

[58] Field of Search ..... 377/6, 11, 53, 10

[56] References Cited

U.S. PATENT DOCUMENTS

| | | | |
|---|---|---|---|
| 3,692,980 | 9/1972 | Getker et al. | 377/6 |
| 3,900,718 | 8/1975 | Seward | 377/6 |
| 3,949,313 | 4/1976 | Tamada et al. | 329/106 |
| 4,139,766 | 2/1979 | Conway | 377/6 |
| 4,280,625 | 7/1981 | Grobbelaar et al. | 377/11 |
| 4,286,149 | 8/1981 | Ben-Nathan et al. | 377/53 |
| 4,494,656 | 1/1985 | Shay et al. | 377/53 |

FOREIGN PATENT DOCUMENTS

| | | |
|---|---|---|
| 1146292 | 3/1963 | Fed. Rep. of Germany . |
| 2280443 | 2/1976 | France . |
| 2455264 | 11/1980 | France . |
| 961614 | 6/1964 | United Kingdom . |

OTHER PUBLICATIONS

"Double Document Detect System" by W. A. Boothroyd, IBM Technical Disclosure Bulletin, vol. 19, No. 12, May 1977, pp. 4749 and 4750.

*Primary Examiner*—John S. Heyman

*Attorney, Agent, or Firm*—Cushman, Darby & Cushman

[57] ABSTRACT

A counting apparatus for counting objects, such as chicks, passed in succession over a conveyor belt through a light beam present between a light source and a photodetector, in which the photodetector produces a detection signal upon each passage of an object through the light beam, which detection signal is applied to a voltage-to-frequency converter for conversion into a frequency varying in accordance with the magnitude of the detection signal, and which detection signal is also applied to a pulse former for conversion into a count pulse whose width is indicative of the period of time required for an object to pass by; wherein the number of cycles of the frequency is counted in a data counter during the period of time that a count pulse is present, and the count pulse is applied to an object counter in response to the data counter having counted a given number of cycles.

13 Claims, 6 Drawing Figures

COUNTING APPARATUS FOR COUNTING OBJECTS BY MEANS OF A SHADOW MEASUREMENT

The invention relates to a counting apparatus for counting objects, particularly chicks successively passing by a photodetector.

It is known to pass objects to be counted in succession over a conveyor belt through the light beam present between a light source and a photodetector, in which the photodetector produces a signal in response to each object passing through the beam, which signal is applied to a counter. The count thus achieved is highly reliable, provided the objects pass through the light beam in single-file, spaced-apart succession.

However, a problem arises when, for example, two objects pass by the photodetector while in contact with each other. In that case, these two objects will be counted as one.

Although, in general, one is able to guide the objects past a photodetector as separate units, it becomes difficult to do so when the objects are, for example, chicks. In fact, live objects can move and hence readily get into contact with one another and, moreover, change their form, at any rate within certain limits.

It is an object of the invention to provide a counting apparatus capable of producing a reliable count of the number of objects passing by the photodetector, even if, for example, two of the chicks pass in contacting juxtaposition.

The invention specifically concerns the measurement of the shadow area formed when a chick passes through the light beam, in which not only the period of time lapsing between the leading and trailing edges of the shadow area, i.e. the width of this shadow area, is measured but also the height of the shadow area is determined.

Experience has shown that when, for example, two chicks are passed by the photodetector while in contacting juxtaposition on the conveyor belt, the width of the shadow area of each one of these chicks will be smaller than that of the shadow area caused by the individual passage of a single chick but that, however, the height is utilized in the counting apparatus according to the invention.

To this end, in accordance with the invention the counting apparatus includes a plurality of light receptors for receiving the light beam, which receptors are mounted in-line vertically the changes in the intensity of the collected light being detected by the photodetector; a voltage-to-frequency converter for converting the detection signals into a frequency varying in accordance with the magnitudes of the detection signals; a pulse former for converting the detection signals into count pulses whose width is indicative of the period of time required for an object to pass by; and a data counter for counting the number of cycles of the frequency during the period of time that a count pulse is present, an object pulse being applied to the object counter in response to the data counter having counted a given number of these fluctuations.

On account of the vertical arrangement of the light receptors, which may be optical fibers, the present invention renders it possible to determine the height of the object. In fact, the height of an object is decisive of the number of optical fibers receiving no light, and is converted in the voltage-to-frequency converter into a frequency depending upon the light passed by one or more of these fibers.

The period of time required for an object to pass by is indicative of the width of this object and is recorded in the pulse former. In other words, the shadow area formed by the object is measured in this manner. The fact whether this shadow area passes by the optical fibers on a higher or lower level is therefore immaterial to the measurement, which is an advantage when counting live objects such as chicks. It had appeared, moreover, that the shadow area projected onto the optical fibers results in a far more accurate measurement. By means of the frequency produced by the voltage-to-frequency converter and the count pulses produced by the pulse former it is possible to establish in a simple manner whether two or more chicks pass by in contacting juxtaposition. Furthermore, this arrangement permits the measurement to be further perfected by means of various modifications.

For example, in accordance with the invention the data counter may include a measuring counter for establishing and storing therein the average number of cycles per object as determined on the basis of a number of objects passing by the photodetector, and a comparator for comparing this stored average number of cycles to the number of cycles occurring in response to the passage of an object, which comparator is further operative to produce at least one object pulse if the latter number is at least equal to or higher than the stored average number.

The data counter may further include circuitry composed of a value adjusting circuit and a summing circuit, in which circuitry the value representing the average number of cycles stored in an average value memory included in the aforesaid measuring counter can be changed by means of the value adjusting circuit into at least one other value, which at least one other value is applied to the comparator, so that when the passage of an object causes the application to the comparator of a number of cycles differing from the average number stored in the average value memory, an object pulse is produced by this comparator only if that number of cycles is at least equal to the aforesaid other value applied to the comparator through the summing circuit.

An additional advantage of the invention is that the intensity of the light beam can be controlled in a simple manner. An optimally constant intensity of the light beam is essential for a proper measurement. In fact, this intensity will be strongly affected by aging of the light source and by dust and other contaminations caused by the chicks passing on the conveyor belt, which factors tend to reduce the beam's intensity. By operating the light source, when new, at a supply voltage lower than nominal, a certain range for re-adjusting the supply voltage is achieved.

In accordance with the invention, such re-adjustment of the supply voltage can be realized by means of a voltage control device including a regulating circuit for regulating the supply voltage of the light source, the detection signals being applied to the regulating circuit to so regulate the voltage of the light source that the photodetector produces a predetermined quiescent detection signal when no object passes thereby; and a set-reset circuit to which the count pulses are applied, which circuit is responsive to the leading edge and the trailing edge of a count pulse to apply an inhibit signal and a release signal, respectively, to the regulating circuit.

An embodiment of the invention will be described in greater detail hereinafter with reference to the accompanying drawings, in which:

FIG. 1 schematically shows the structure of the counting apparatus;

FIG. 4 shows a block diagram of the circuitry for producing the frequency and the count pulses indicative of the size of an object passing by;

Figure 1:
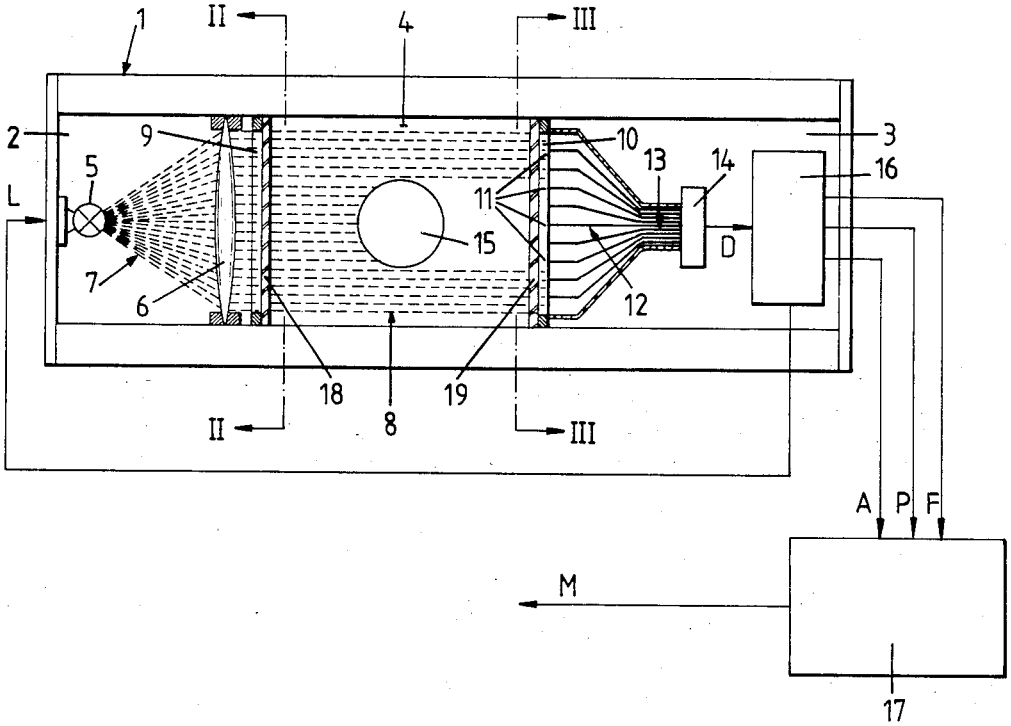
Figure 2:
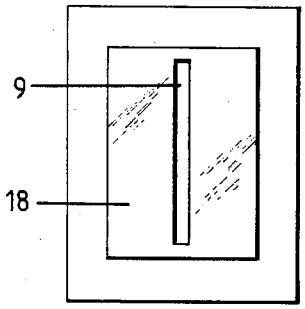
FIGS. 2 and 3 show the forming of the light beam, FIG. 2 showing the situation at the emitting end in sectional view along the line II—II of FIG. 1 and FIG. 3 showing the situation at the receiving end in sectional view along the line III—III of FIG. 1.
Figure 3:
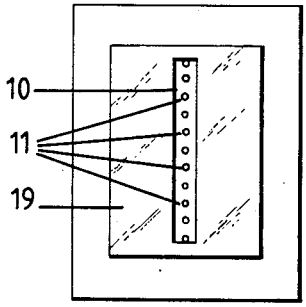

The counting apparatus shown in FIG. 1 comprises a box-shaped member 1 having a left section 2, a right section 3 and a passageway 4 for the object to be counted between sections 2 and 3. Section 2 houses a light source 5, e.g. a halogen lamp, and a lens 6 with the light source mounted in the focal point of the lens. The divergent light beam 7 emitted by light source 5 is converted by lens 6 into a parallel light beam 8, which beam 8 is passed through a vertical slot 9 (FIG. 2) to extend as a vertical beam through passageway 4 and impinge upon a vertical slot 10 (FIG. 3) mounted in section 3 of box-shaped member 1. Slot 10 provides access to the spaced-apart entrance ends 11 of a plurality of vertically superimposed light receptors, e.g. optical fibers 12, having their exit ends 13 united into a single exit area located in close proximity to a photodetector 14 for detecting the amount of light in dependence upon an object 15 passed through passageway 4. The detection signals D produced by the photodetector are applied to and processed in electronic circuit arrangements 16 and 17 shown in greater detail in FIGS. 4 and 5, which will be discussed later on.

Passageway 4 is separated from left section 2 by a transparent plate 18 and from right section 3 by a transparent plate 19, which plates are made of, for example, a plastic or glass. These plates 18 and 19 serve to protect the interior of sections 2 and 3 against dirt entrained by objects passing through passageway 4. Especially when these objects are, for example, chicks, large amounts of dust and dirt can remain in passageway 4.

Figure 4:
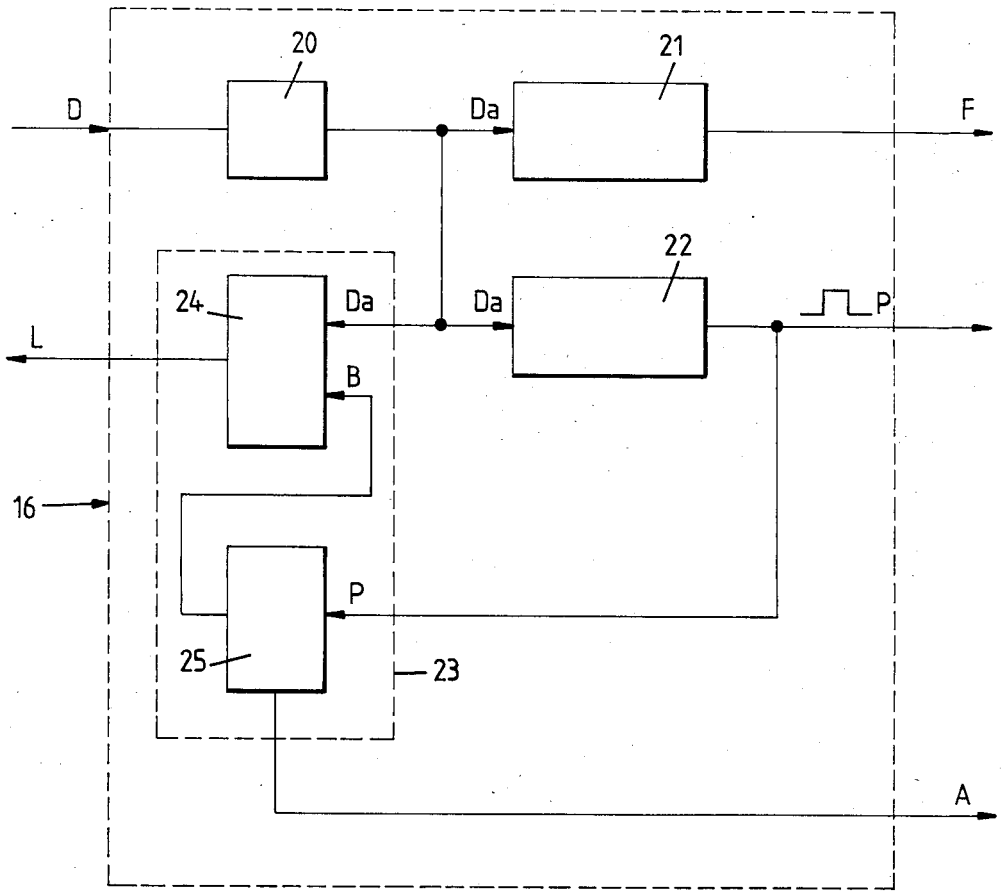

As shown in FIG. 4, the detection signals D produced by the photodetector are applied to an amplifier 20 and the amplified detection signals Da are applied to a voltage-to-frequency converter 21 and a pulse former 22.

In voltage-to-frequency converter 21 the detection signals Da are converted into a frequency F varying in accordance with the magnitudes of detection signals Da, which frequency F is directly proportional to the height of the shadow area formed by passing object 15 on the plane of the entrance ends 11 of optical fibers 12.

Concurrently with the production of frequency F by converter 21, a pulse P is generated by the pulse former 22, the width of which pulse is indicative of the period of time required for object 15 to pass by.

Pulse former 22 may include a threshold circuit (not shown) operative to so affect the width of pulse P that the leading edge thereof is defined as occurring in response to detection signal Da transgressing a predetermined threshold value in upward sense and the trailing edge thereof is defined as occurring in response to this detection signal transgressing the threshold value in downward sense during the passage of object 15.

The aforesaid frequency F and the count pulses P are applied to the electronic processor 17.

FIG. 4 further shows a voltage control device 23 for regulating the supply voltage of light source 5, which device 23 includes a regulating circuit 24 and a set-reset circuit 25. The amplified detection signals Da are applied to regulating circuit 24 to so regulate the supply voltage L of light source 5 that detector 14 produces a predetermined quiescent signal when no object 15 passes thereby. By operating light source 5 at, for example, 85% of its nominal voltage value, a margin is provided for readjustment of the supply voltage to 100% in the event that the intensity of light beam 7,8 has to be increased in order to have this beam supply the same amount of light to optical fibers 12 when plates 18 and 19 have become dirty. When the supply voltage is so re-adjusted that source 5 operates at its nominal voltage, an alarm signal A will be generated by voltage control device 23, which signal A is applied to an alarm means 42 fitted in an information panel 40 shown in FIG. 5 for the purpose of providing, for example, an acoustic indication. In response to such an indication, the operator can actuate an air supply device or some other type of cleaning device (not shown) for removing dirt and dust from plates 18 and 19. Should the supply voltage remain adjusted at the nominal voltage value of light source 5 in spite of such a cleaning of plates 18 and 19, this may be an indication of the need for replacement of the source (halogen lamp) due to aging.

An additional advantage of this supply voltage regulation is that voltage fluctuations in the mains network to which the light source is connected are compensated for by the voltage control device 23 too, so that intensity fluctuations in the light beam as caused by such mains voltage fluctuations are likewise compensated for and hence a highly reliable measurement is achieved.

In order not to interfere with the measurement of the shadow area of a passing object and hence with the counting procedure, the re-adjustment of the supply voltage should take place in the absence of an object in the passageway. To this end, the set-reset circuit 25 is employed. Count pulses P produced by pulse former 22 are applied to circuit 25. The leading edge and the trailing edge of a count pulse P are converted in circuit 25 into an inhibit and a release pulse B, respectively, operative to inhibit the operation of regulating circuit 24 for the duration of the count pulses.

Figure 5:
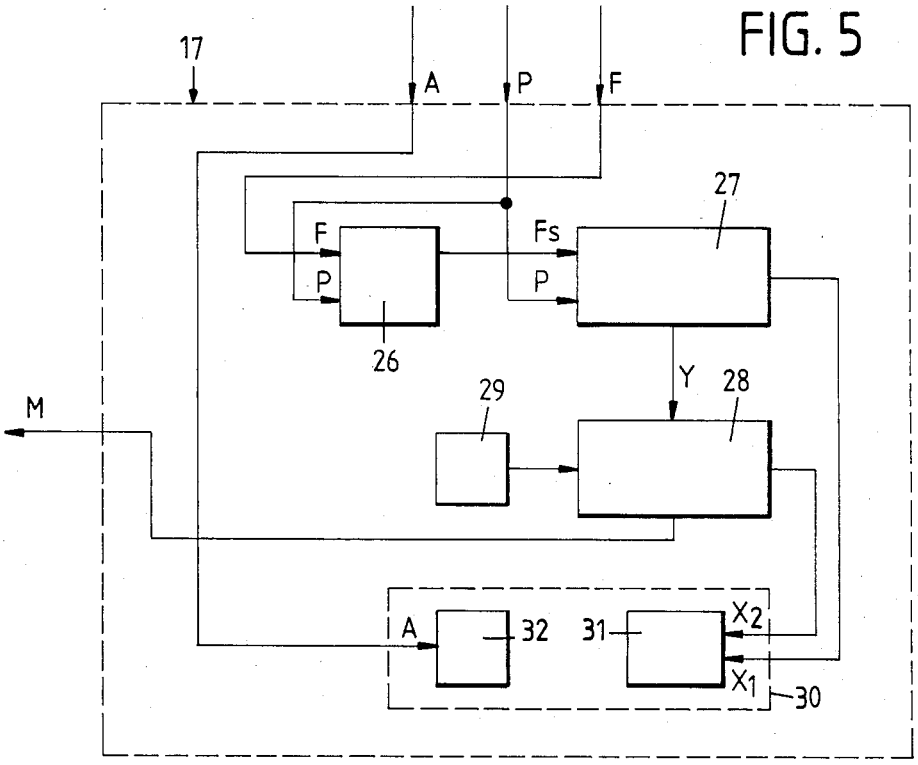
FIG. 5 shows a block diagram of the circuitry for processing signals produced by the circuitry of FIG. 4.

As shown in FIG. 5, frequency F and count pulses P are applied to the electronic processor 17. Frequency F is applied through a gating circuit 26 to a data counter 27. Furthermore, count pulses P from pulse former 22 are applied to gating circuit 26 and data counter 27, the gating circuit passing the frequency F only during the presence of pulses P. The pulse width is indicative of the number of cycles of this frequency to be passed and applied to data counter 27. This data counter determines on the basis of the number of cycles and the count pulses whether one or more object pulses Y are applied to an object counter 38. If the objects to be counted pass through passageway 4 in spaced-apart succession, data counter 27 will apply an object pulse Y to object counter 38 after the passage of each object. However, if two or more objects are in contacting juxtaposition or if the objects are larger or smaller than the average object size, the information acquired from these objects will be additionally compared to reference values to be discussed later on with reference to FIG. 6.

The object pulses Y received by the object counter 38 are added to a value preset by means of an object number counter 39, after which the object counter 38 applies a control pulse M to a control mechanism (not shown) for actuating an object processor connectable to the counting apparatus.

Information panel 40 shown in FIG. 5 includes, besides the earlier-mentioned alarm means 42, a display unti 41 for displaying information as to, for example, the average number of pulses per chick, the number of boxes filled with chicks, the number of chicks per box, etc. To realize the desired display of information, suitable signals $X_1$, and $X_2$ are applied by data counter 27 and object counter 38, respectively, to display unit 41.

Figure 6:
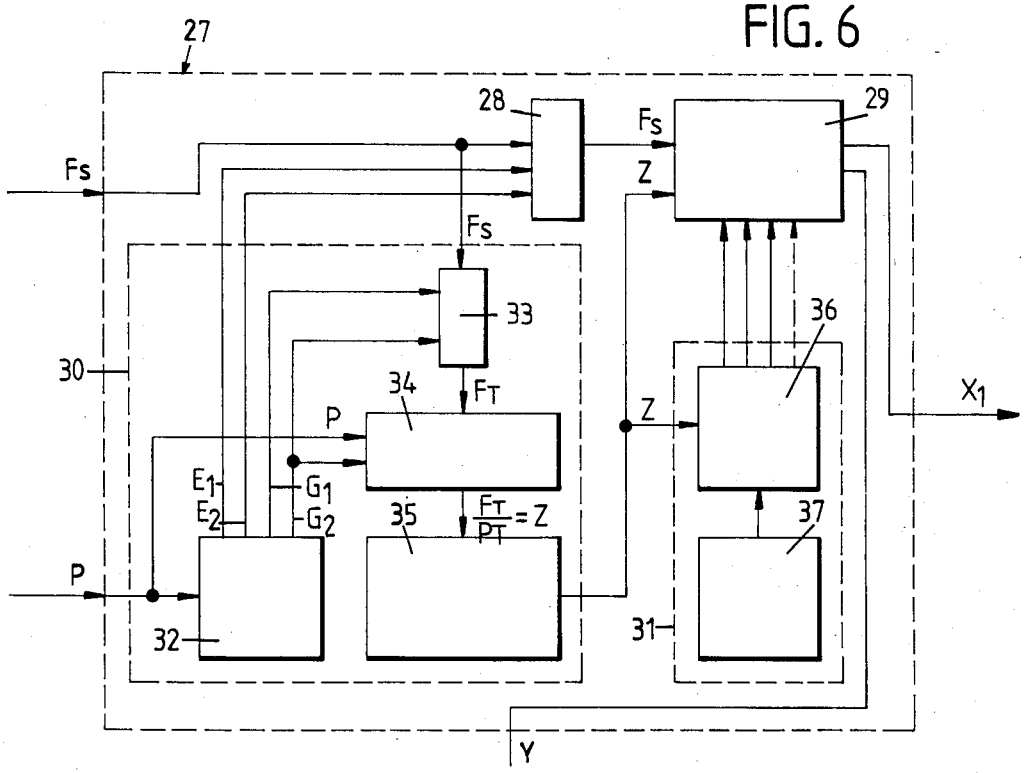
FIG. 6 shows a block diagram of the circuitry constituting the data counter of FIG. 5.

FIG. 6 shows data counter 27 in greater detail. The number of cycles Fs each time passed by gating circuit 26 is applied through a second, normally open gating circuit 28 to a comparator 29 in which the number of cycles Fs is compared to a preset average value Z stored in a measuring counter 30, the comparator being adapted to producan object pulse Y if the number of cycles Fs is at least equal to the average value Z stored.

Should the number of cycles appear higher than value Z stored, this number is compared to one or more preset values of a circuit 31.

For obtaining the average value Z, the measuring counter 30 is provided with a monitoring circuit 32 in which a predetermined count value can be set as corresponding to a known number of objects passed in spaced-apart succession through passageway 4. Upon the initiation of a counting procedure, pulses P produced by pulse former 22 are applied to monitoring circuit 32, in response whereto this circuit 32 applies an inhibit pulse E1 to gating circuit 28 and a release pulse G1 to a gating circuit 33 in order to apply the number of cycles to be counted only through gating circuit 33 to an average value divider 34. In this divider 34 the cycles caused by all objects are added to each other until the number of pulses P is equal to the count value stored in monitoring circuit 32. If the number of count pulses P is equal to the count value, monitoring circuit 32 applies an inhibit pulse G2 to gating circuit 33, which inhibit pulse G2, which is also applied to divider 34, ensures that the total number of cycles FT is divided by the total number of count pulses PT likewise applied to this divider. The quotient FT/PT=Z is stored in an average value memory 35 as the average number of cycles per object.

Concurrently with the production of inhibit pulse G2, monitoring circuit 32 applies a release pulse E2 to gating circuit 28, so that during the normal counting procedure the cycles are applied through gating circuit 28 to comparator 29.

Value Z stored in memory 35 is applied not only to comparator 29 but also to circuit arrangement 31, in which circuit arrangement value Z is increased in summing circuit 36 by one or more values set by value adjusting circuit 37, which circuit 37 is adapted to optionally set these one or more values.

By means of this circuit arrangement 31 it is possible to ascertain whether the number of cycles is associated with one separate object or with, for example, two or more objects in containing juxtaposition.

When the number of cycles appears equal to or higher than, for example, 120% of the average measuring value, at least one object is concerned and an object pulse Y is produced by the comparator, while when the number of cycles appears to be higher than, for example, 240% of the average value, apparently at least two objects in contacting juxtaposition are concerned and a second object pulse is produced by the comparator.

By means of measuring counter 30 and circuit arrangement 31 it is further possible to prohibit the counting of small foreign objects passing through passageway 4. Small objects will result in a lower frequency and hence less cycles per object.

Furthermore, by means of circuit arrangement 31 the average value Z can be reduced in the event that the objects to be counted appear to be of smaller or more greatly varying size.

Consequently, the invention permits a highly reliable counting of objects, particularly chicks, even in the event of one or more of such chicks being in contacting juxtaposition. Foreign objects present between the chicks and of smaller size than these chicks, such as the egg-shells from which the chicks have emerged, are ignored in the counting.

The above describes a possible embodiment of the invention. Self-evidently, various modifications and alterations are possible without exceeding the scope of the invention.

I claim:

1. A counting apparatus for counting objects passed in succession through a light beam present between a light source and a photodetector, in which the photodetector produces a detection signal upon each passage of an object through the light beam, the magnitude of which detection signal depends on the amount of light received by the photodetector and which detection signals are applied to an object counter for counting the number of objects so passed, characterized in that said counting apparatus includes a plurality of light receptors (12) for receiving the light beam (7,8), which receptors (12) are mounted, in-line vertically, the changes in the intensity of the collected light being detected by said photodetector (14); a voltage-to-frequency converter (21) joined to said photodetector for converting the detection signals (D, Da) into a frequency (F) varying in accordance with the magnitudes of the detection signals; a pulse former (22) also joined to said photodetector for converting the detection signals (D, Da) into count pulses (P) whose width is indicative of the period of time required for an object (15) to pass by; and a data counter (27) operatively connected to said converter (21) and the pulse former (22) of cycles (Fs) of said frequency (F) during the period of time that a count pulse (P) is present, an object pulse (Y) being applied from the data counter (27) to said object counter (38) in response to the data counter having counted a given number of said cycles (Fs).

2. A counting apparatus according to claim 1, characterized in that said data counter (27) includes a measuring counter (30) for establishing and storing therein the average number of cycles (Fs) per object (15) as determined on the basis of a number of objects passing by said photodetector (14), and a comparator (29) for comparing said stored average number of cycles (Fs) to the number of cycles (Fs) occurring in response to the passage of each object (15) to be counted, said comparator further being operative to produce at least one object pulse (Y) if the latter number is at least equal to or higher than said stored average number.

3. A counting apparatus according to claim 1, characterized in that said measuring counter (30) includes a monitoring circuit (32) for determining an average measuring value on the basis of a given number of objects, to which end said monitoring circuit (32) produces a release pulse (G1) upon the initiation of the determination procedure and produces an inhibit pulse (G2) after said given number of objects has passed by said photodetector (14); a gating circuit 33 for passing the cycles (Fs) to be counted as caused by said given number of objects, which gating circuit (33) is released and inhibited by said release pulse (G1) and said inhibit pulse (G2), respectively, produced by said monitoring circuit (32); an average value divider (34) responsive to said inhibit pulse (G2) for dividing the total number of cycles (Fs) passed by said gating circuit (33) by the total number of count pulses (P) as corresponding to said given number of objects; and an average value memory (35) in which the resultant quotient (Z) is stored.

4. A counting apparatus according to claim 3, characterized in that said data counter (27) includes a circuit arrangement (31) composed of a value adjusting circuit (37) and a summing circuit (36), in which circuit arrangement (31) the value representing the average number (Z) of cycles (Fs) stored in said average value memory (35) can be changed by means of said value adjusting circuit (31) into at least one other value, which at least one other value is applied to said comparator (29), so that when the passage of an object causes the application of said comparator (29) of a number of cycles (Fs) differing from said average number stored in said average value memory (35), an object pulse (Y) is produced by said comparator (29) only if said number of cycles (Fs) is at least equal to said other value applied to said comparator (29) through said summing circuit (36).

5. A counting apparatus according to claim 1, characterized in that the cycles (Fs) are applied from said voltage -to-frequency converter (21) to said data counter (27) through one of the inputs of a gating circuit (26) having two inputs and one output, and the count pulses (P) are applied to the other of said inputs of said gating circuit (26), the leading edge and the trailing edge of each one of said count pulses (P) being operative to release and inhibit, respectively, said gating circuit (26), said circuit (26) having its output connected to said data counter (27).

6. A counting apparatus according to claim 1, characterized in that said voltage-to-frequency converter (21) produces output signals (F) in response to the detection signals transgressing a predetermined value in upward sense and said converter (21) inhibits output signals (F) in response to said detection signals transgressing said value in downward sense, and that the leading and trailing edges of the count pulses (P) produced by said pulse former (22) may likewise be defined as occurring in response to said detection signals transgressing said predetermined value in upward sense and in downward sense, respectively.

7. A counting apparatus according to claim 1, characterized in that the frequency produced by said voltage-to-frequency converter (21) is directly proportional to the height of the shadow area cast by an object (15) on said light receptors (12).

8. A counting apparatus according to claim 1, characterized by the provision of a voltage control device (23) for said light source (5), which device (23) includes a regulating circuit (24) for regulating the supply voltage (L) of said light source (5), said detection signals (Da) being applied to said regulating circuit (24) in order to so regulate said voltage (L) of said light source (5) that said photodetector (14) produces a predetermined quiescent detection signal when no object passes thereby; and a set-reset circuit (25) to which said count pulses (P) are applied, which circuit (25) is responsive to the leading edge and the trailing edge of a count pulse (P) to apply an inhibit signal and a release signal, respectively, to said regulating circuit (24).

9. A counting apparatus according to claim 8, characterized in that said voltage control device (23) produces an alarm pulse (A) in response to said supply voltage (L) being re-adjusted by said regulating circuit (24) so that it exceeds a maximum value, which alarm pulse is applied to an alarm indicator (32).

10. A counting apparatus according to claim 8, characterized by the provision of an information panel 40 connected to said data counter (27), said object counter (38) and said voltage control device (23) for the visual reproduction of the information provided by said counter, said object counter and said voltage control device .

11. A counting apparatus according to claim 1, characterized in that said light beam (7,8) is directed in vertical sense through a vertical beam slot (9) onto said receptors (12).

12. A counting apparatus according to claim 1, characterized in that said light receptors (12) are optical fibers.

13. A counting apparatus according to claim 2 characterized in that after counting a predetermined number of object pulses (Y) produced by said comparator (29), said object counter (38) applies a control pulse (M) to a control mechanism for actuating an object packaging device connectable to the counting apparatus.

* * * * *